US010919177B2

(12) United States Patent
Boswell et al.

(10) Patent No.: US 10,919,177 B2
(45) Date of Patent: Feb. 16, 2021

(54) SEMI-AUTOMATED WOOD-CUTTING MACHINE AND METHOD

(71) Applicant: INDEPENDENT STAVE COMPANY, LLC, Lebanon, MO (US)

(72) Inventors: James Bradley Boswell, Lebanon, MO (US); Michael Joel Nagy, Lebanon, MO (US); Patrick Jean-Marie Eisen, Ville-sur-illon (FR)

(73) Assignee: INDEPENDENT STAVE COMPANY, LLC, Lebanon, MO (US)

( * ) Notice: Subject to any disclaimer, the term of this patent is extended or adjusted under 35 U.S.C. 154(b) by 364 days.

(21) Appl. No.: 15/438,935

(22) Filed: Feb. 22, 2017

(65) Prior Publication Data

US 2018/0178405 A1 Jun. 28, 2018

(30) Foreign Application Priority Data

Dec. 27, 2016 (EP) ..... 16306824

(51) Int. Cl.

| | |
|---|---|
| ***B27M 1/08*** | (2006.01) |
| ***B27G 3/00*** | (2006.01) |
| ***B27G 19/02*** | (2006.01) |
| ***B27B 5/02*** | (2006.01) |
| ***B27H 3/02*** | (2006.01) |

(52) U.S. Cl.

CPC ..... *B27M 1/08* (2013.01); *B27B 5/02* (2013.01); *B27G 3/00* (2013.01); *B27G 19/02* (2013.01); *B27H 3/02* (2013.01)

(58) Field of Classification Search

CPC ... B27H 3/02; B27H 3/00; B27H 3/04; B27H 5/00; B27H 5/02; B27H 5/04; B27H 5/08; B27M 1/08; B27B 5/02; B27B 5/04

USPC ..... 144/367, 1.1, 136.1, 137, 138, 242.1, 144/245.1; 83/410.7–411.7

See application file for complete search history.

(56) References Cited

U.S. PATENT DOCUMENTS

| | | | | |
|---|---|---|---|---|
| 241,137 A | | 5/1881 | Holmes | |
| 459,646 A | | 9/1891 | Pleukharp | |
| 564,203 A | * | 7/1896 | Kellogg | B27H 1/00 144/256.1 |
| 1,441,369 A | * | 1/1923 | Olai | B27H 3/02 147/27 |
| 1,476,041 A | | 12/1923 | Bolinder | |
| 1,711,388 A | * | 4/1929 | Houtz | B27C 5/00 147/29 |
| 2,050,461 A | | 8/1936 | Perry | |
| 2,235,271 A | * | 3/1941 | Walstrom | B27H 3/02 147/1 |

(Continued)

FOREIGN PATENT DOCUMENTS

| | | | |
|---|---|---|---|
| FR | 2994879 B1 * | 5/2015 | B23D 47/047 |
| FR | 3023742 | 1/2016 | |
| WO | 9800269 | 1/1998 | |

OTHER PUBLICATIONS

Extended European Search Report for Application No. 16306824.0, dated Jun. 7, 2017, 8 pages.

*Primary Examiner* — Shelley M Self
*Assistant Examiner* — Jared O Brown
(74) *Attorney, Agent, or Firm* — Armstrong Teasdale LLP

(57) ABSTRACT

A semi-automated wood-cutting machine includes a receiving/alignment stage adapted to receive a piece of wood, the receiving/alignment stage having an alignment aid adapted to facilitate manual alignment of the piece of wood, and a cutting stage spaced from the receiving/alignment stage, the cutting stage being configured to cut the piece of wood along a predetermined cut pathway.

19 Claims, 11 Drawing Sheets

(56) References Cited

U.S. PATENT DOCUMENTS 2,682,285 A * 6/1954 Blum ..... B27H 3/02 83/409.1
2,864,412 A * 12/1958 Ponder ..... B27M 3/20 144/134.1
3,062,251 A * 11/1962 Evans ..... B27B 5/22 147/19
3,128,881 A * 4/1964 Kuhnle ..... B65B 1/46 177/52
3,367,375 A * 2/1968 Watson, Jr. ..... B27M 3/32 83/404.1
3,479,772 A * 11/1969 Yoder ..... B24B 21/02 451/307
3,842,723 A 10/1974 Boucher
5,154,687 A * 10/1992 Jeslis ..... B31D 5/04 198/478.1
5,343,911 A * 9/1994 Humphrey ..... B27B 31/06 144/134.1
5,421,072 A * 6/1995 Kuban ..... B23Q 16/06 29/38 A
7,080,431 B2 * 7/2006 Sawyer ..... B23D 47/04 144/35.1
7,712,495 B1 * 5/2010 Hurst ..... B27M 3/32 144/12
7,861,753 B2 * 1/2011 Walker ..... B27C 5/00 144/356
7,950,316 B2 * 5/2011 Koskovich ..... B27B 5/205 269/269
7,966,714 B2 * 6/2011 Dick ..... B27M 1/08 29/563
8,720,503 B2 * 5/2014 Roberts ..... B27H 3/02 144/2.1
2005/0120840 A1 * 6/2005 Koskovich ..... B23D 59/001 83/13
2007/0028729 A1 * 2/2007 Quick ..... B27B 31/06 83/13
2008/0078470 A1 * 4/2008 O'Branion ..... B27B 5/32 144/356
2012/0186701 A1 * 7/2012 Roberts ..... B27H 3/02 147/35.5
2017/0209974 A1 * 7/2017 Angel ..... B23Q 17/0985
2017/0274553 A1 * 9/2017 Martinez ..... B23Q 7/165

* cited by examiner

SEMI-AUTOMATED WOOD-CUTTING MACHINE AND METHOD

FIELD

The present disclosure relates generally to wood-cutting machines and, more particularly, to a semi-automated wood-cutting machine.

BACKGROUND

There are many situations in which it is desired to cut wood according to particular specifications, including geometrically complex specifications, such as curves, tapers, bevels, etc. For example, wooden barrels, such as those used in the production of wine or whiskey, are constructed from a plurality of discrete wood pieces known as staves. Staves are cut or otherwise formed in a particular manner (e.g., curved, tapered, and beveled) so that a plurality of the discrete staves can be circumferentially arranged to form an individual wooden barrel.

Some known wood-cutting machines designed to cut staves and other such wood pieces are manually operated. One known manually operated wood-cutting machine includes a plurality of blades that are configured to both cut the tapered edges of the stave and appropriately bevel the cut edge. An operator activates the blades, places a plank into the wood-cutting machine, and manually pushes the plank against the blades to cut and bevel the plank into a stave. An example of such a machine is disclosed in U.S. Pat. No. 241,137, which was issued in 1881 to Edward and Britain Holmes.

Some of these known machines have a host of disadvantages. First, these wood-cutting machines, as the blades must necessarily be exposed to the operator for manual pushing of the stave against the blades, can be messy to operate. Debris, such as wood chips, wood shavings, and/or sawdust, quickly builds up around the machine and within the operating environment. Moreover, operation of such machines can be time-consuming, as each individual stave must be manually arranged and pushed against the blades.

Automated wood-cutting machines have been developed, in an effort to reduce the time needed to cut the staves. However, such fully automated machines lack an opportunity for operator oversight. Accordingly, staves from such machines may include imperfections, such as knots or sap. These imperfections can compromise the integrity of a formed barrel. Operators using the manual wood-cutting machines described above typically remove such imperfections during the initial formation of the stave. In the case of the automated wood-cutting machines, however, imperfections must be identified and manually removed after the stave has been formed, adding more operator time and effort. Moreover, some of these staves may not be salvageable, increasing waste and cost.

It is desirable, therefore, to provide a semi-automated wood-cutting machine that overcomes the above-described disadvantages. More specifically, it is desirable to provide a semi-automated wood-cutting machine that increases stave production time, increases operator safety, provides for a cleaner work environment, and produces staves free of imperfections.

SUMMARY

In one aspect, a semi-automated wood-cutting machine includes a receiving/alignment stage adapted to receive a piece of wood, the receiving/alignment stage having an alignment aid adapted to facilitate manual alignment of the piece of wood. The semi-automated wood cutting machine also includes a cutting stage spaced from the receiving/alignment stage, the cutting stage being configured to cut the piece of wood along a predetermined cut pathway.

In another aspect, a semi-automated wood-cutting machine includes a receiving/alignment stage adapted to receive a piece of wood, the receiving/alignment stage having an alignment aid adapted to facilitate manual alignment of the piece of wood. The semi-automated wood-cutting machine also includes a rough-cutting stage spaced from the receiving/alignment stage, the rough-cutting stage being configured to cut the piece of wood along a predetermined cut pathway. The semi-automated wood-cutting machine further includes a finishing stage spaced from the receiving/alignment stage and the rough-cutting stage, the finishing stage being configured to contour at least one longitudinal extending edge of the piece of wood.

In yet another aspect, a method of cutting a piece of wood includes manually aligning a piece of wood relative to an alignment aid at a receiving/alignment stage of a semi-automated wood-cutting machine, actuating an actuator to move the piece of wood along a predetermined route from the receiving/alignment stage to a cutting stage, and cutting the piece of wood along at least one of its longitudinally extending edges at the cutting stage.

DETAILED DESCRIPTION OF THE DRAWINGS

The present disclosure provides one suitable embodiment of a semi-automated wood-cutting machine that improves throughput, improves safety, and decreases environmental debris. More specifically, the wood-cutting machine disclosed herein leverages the skill of operators in optimizing the placement of wood pieces into the wood-cutting machine. By locating the cutting assemblies remote from the operator by a secure housing and adding sensors around the operating environment, the wood-cutting machine can be operated safely. In addition, the semi-automated wood-cutting machine described herein facilitates improved debris collection and significantly reduces the debris around the operating environment. Moreover, the disclosed semi-automated wood-cutting machine provides for greater stave output compared to conventional manually operated wood-cutting machines. Although the wood-cutting machine is described as cutting staves for forming wooden barrels, it should be readily understood that the wood-cutting machine may be used to cut other wood pieces in other wood-working fields, such as furniture production.

Figure 1A:
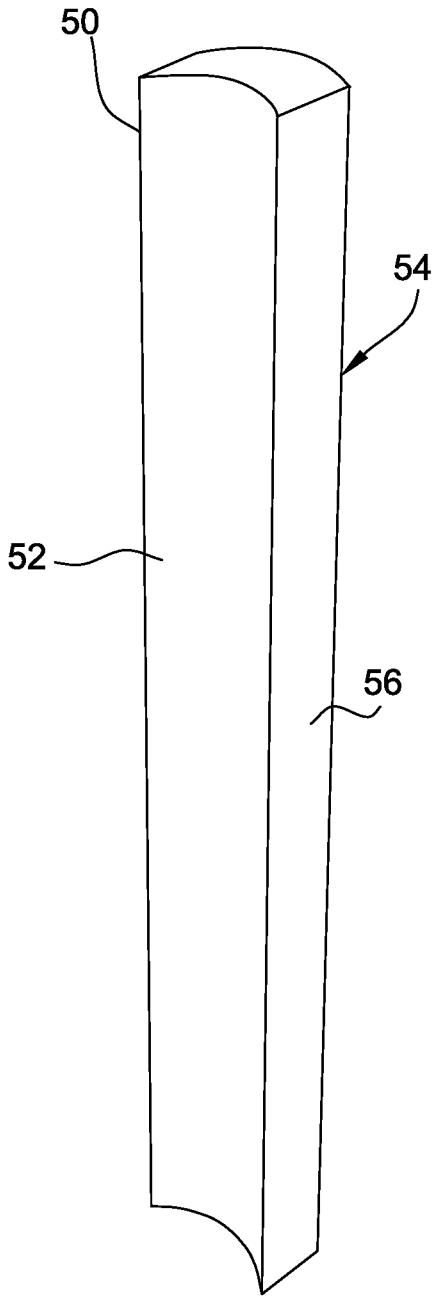
FIG. 1A is a perspective of a wood plank (or slat) suitable for forming a stave.
Figure 1B:
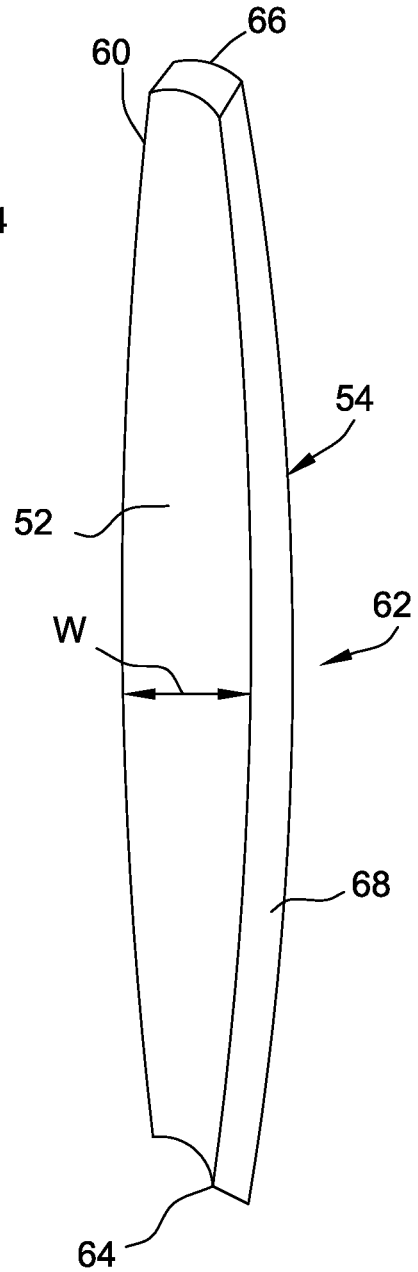
FIG. 1B is a perspective of a stave formed from the wood plank of FIG. 1A.
Figure 2:
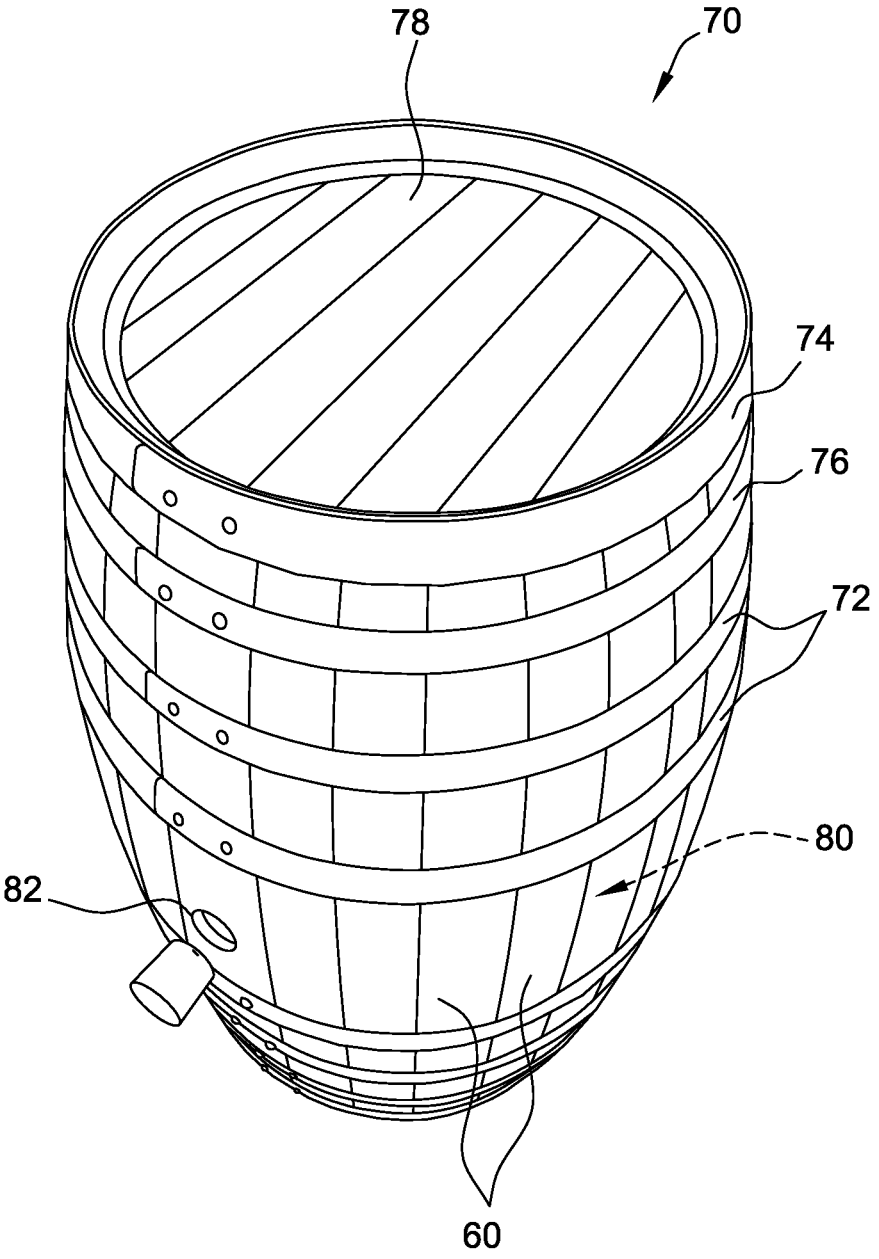
FIG. 2 is a perspective of one suitable embodiment of a wooden barrel formed from a plurality of staves, such as the stave illustrated in FIG. 1B.

Reference is now made to the drawings and in particular to FIGS. 1A, 1B, and 2. More particularly, FIG. 1A illustrates one suitable example of a wood plank 50 (or slat). As seen in FIG. 1A, the wood plank 50 has a curved interior surface 52 and a curved exterior surface 54. In the illustrated embodiment, the interior surface 52 of the wood plank 50 is concave and the exterior surface 54 is convex. The wood plank 50 is both cut and beveled to form a stave 60, which is illustrated in FIG. 1B. The wood plank 50 is cut along its longitudinally extending edges 56 such that the width W of the stave 60 is at a maximum roughly in the middle 62 of the stave, and tapers towards its ends 64, 66. The edges 68 of the stave 60 are beveled such that the edges 68 taper inward from the exterior surface 54 to the interior surface 52.

Staves used to form barrels, such as the stave 60 illustrated in FIG. 1B, are typically formed from oak (e.g., white oak). However, the barrel-forming staves 60 and/or other wood pieces used for other purposes (e.g., furniture construction) may be formed from any suitable wood. Staves 60 used to form barrels should generally be free from imperfections such as knots and sap. Imperfections in one or more of the staves 60 can compromise the function of the resulting wooden barrel.

One suitable embodiment of a wooden barrel 70 is illustrated in FIG. 2. To form such a barrel 70, staves 60 of varying widths are often used. A plurality of construction rings (not shown, e.g., heavy steel rings) are used to preliminarily form the barrel 70. A head ring, which is a type of construction ring, is used as a form or guide as each stave 60 is added to form a diameter of the barrel 70. Another head ring is added to further secure the staves 60, which still extend in a substantially straight line outward from the first head ring during the forming process. The unformed barrel 70 is typically steamed to make the staves 60 flexible, such that the staves 60 can be bent into the "barrel" shape. Additional construction rings (e.g., "belly rings") may be used to set the staves 60 in position. Ideally, when the barrel 70 cools and dries, it is water tight. Either during or after the drying, the barrel 70 is "toasted", or charred, on an interior surface 80 thereof. The level of toasting/charring affects the final flavor of whatever liquid (e.g., wine, whiskey) is aged therein. The head rings are removed, and the end caps 78 (or "heads") of the barrel 70 are installed. At this point, a plurality of final rings 72 are added to the barrel. For example, head hoops 74 are placed on the barrel 70 adjacent to the heads 78. Belly rings are removed and replaced by a plurality of additional rings (e.g., quarter rings 76). Certain other steps may be performed to finalize the barrel 70, such as cutting a bung hole 82 in one stave 60 for filling of the barrel 70.

Figure 3:
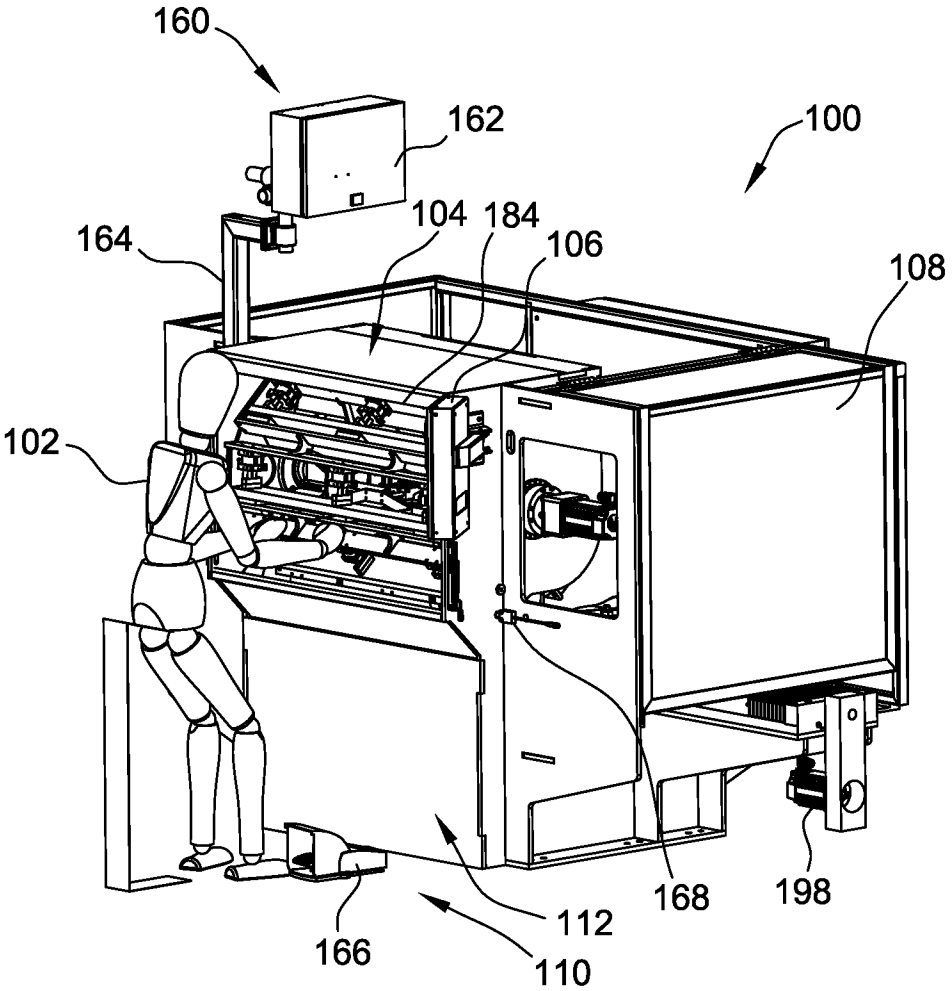
FIG. 3 is front perspective of one suitable embodiment of a semi-automatic wood-cutting machine in accordance with the present disclosure.

Turning now to FIG. 3, a semi-automated wood-cutting machine 100 is illustrated. In one embodiment, the wood-cutting machine 100 is configured to cut and form staves similar to the stave 60 seen in FIG. 1B, that then may be used to form barrels 70 as shown and discussed with respect to FIGS. 1A, 1B, and 2. The wood-cutting machine 100 may be additionally or alternatively configured to cut wood pieces other than staves, for example, in furniture processing and/or any other processes. The wood-cutting machine 100 is "semi-automated" in that the machine 100 incorporates a manual operation component performed by an operator 102 with an automatic component performed by a rough-cutting assembly and a finishing assembly, as described further herein. Accordingly, the semi-automated wood-cutting machine 100 facilitates increasing throughput while enabling the operator input that ensures high-quality finished pieces (e.g., pieces substantially free from natural imperfections such as knots and saps).

More particularly, the operator 102 inserts and properly aligns a wood plank (e.g., as illustrated in FIG. 1A) at a first stage of an indexing station 104 of the wood-cutting machine 100. The operator 102 then activates the indexing station 104. Activating the indexing station 104 causes the wood plank to be securely clamped in place and advanced to a second stage. The operator 102 continues to insert and align wood planks at the first stage of the indexing station 104 and activate the indexing station 104 to advance the wood planks through a plurality of stages. In a further stage, the wood plank is automatically rough-cut by a rough-cutting assembly. In a still further stage, the rough-cut plank is automatically more precisely cut and/or beveled (or otherwise contoured) by a finishing assembly. After being advanced through all stages of the indexing station 104, the now half-formed stave is returned to the first stage and, therefore, to the operator 102. The operator 102 turns the half-formed stave such that the opposite, unfinished longitudinally extending edge is arranged and aligned for processing. The operator 102 advances the half-formed stave through all of the stages until a fully-formed stave (e.g., the stave 60 illustrated in FIG. 1B) is returned to the first stage for removal from the wood-cutting machine 100 by the operator 102.

As used herein "manual" refers to those processes performed with direct intervention or action by the operator 102. In contrast, "automatic" or "automated" refers to those processes performed under the direction of a controller 106 (e.g., a computing device). Automatic processes may be configured and/or programmed by an operator 102 and/or another user but are implemented under the direction of the controller 106 without direction intervention, during such automatic processes, by an operator 102.

As illustrated in FIG. 3, the wood-cutting machine 100 includes a housing 108 that retains the cutting assemblies (see FIGS. 6, 7, and 9-11) therein. In so doing, the wood-cutting machine 100 facilitates keeping an operating environment 110 (i.e., the environment around the operator 102) clean and free of debris. More particularly, a debris collection portion 112 of the housing 108 is configured to collect and retain debris therein, such as wood chips and wood shavings, such that the debris does not collect exterior to the wood-cutting machine 100. Moreover, the housing 108 separates the cutting assemblies, and the blades thereof, from the operator 102 of the wood-cutting machine 100. Accordingly, the wood-cutting machine 100 described herein provides increased safety for the operator 102 thereof, as well as for any other persons that may be near the machine 100.

Figure 4:
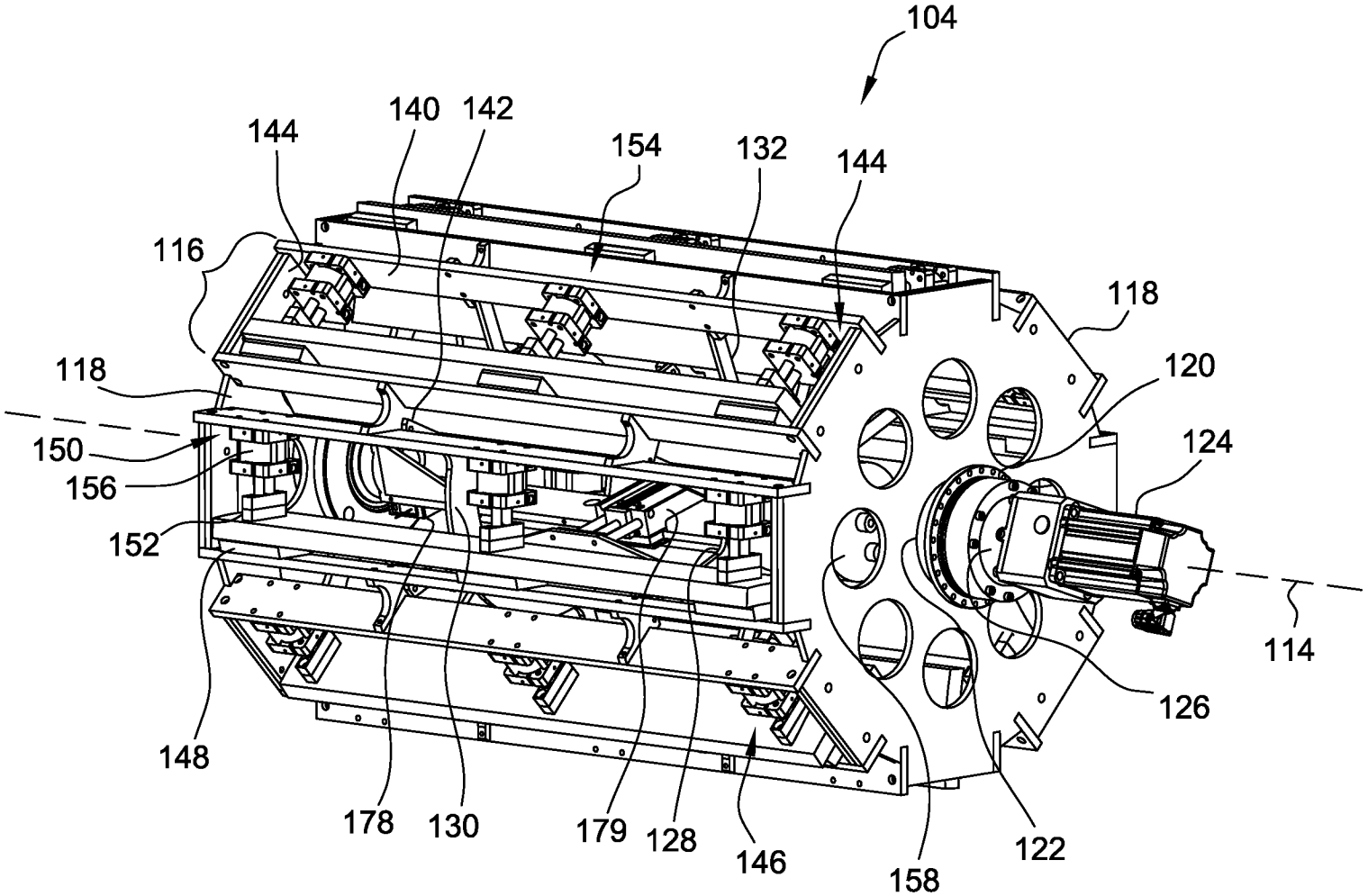
FIG. 4 is a perspective of an indexing station of the wood-cutting machine of FIG. 3.

FIG. 4 illustrates the indexing station 104 removed from the wood-cutting machine 100. As seen therein, the wood-cutting machine 100 includes a plurality of stages. More particularly, the illustrated wood-cutting machine 100 includes eight stages. It should be understood that, in alternative embodiments, the wood-cutting machine 100 may include fewer or additional stages. A "stage" refers to a location or "stopping point" within the indexing station 104 along a generally circular route about a central axis 114.

The indexing station 104 includes a plurality of stage assemblies 116 configured to travel the circular route to each stage. In other words, each stage assembly 116 occupies the space of a stage within the indexing station 104. Accordingly, in the illustrated embodiments, the indexing station 104 includes eight stage assemblies 116. In embodiments in which there are an alternative number of stages, there are a corresponding number of stage assemblies 116. It is contemplated that there may be embodiments including a different number of stage assemblies 116 (i.e., fewer stage assemblies) than stages.

The indexing station 104 includes a pair of hub plates 118 arranged on opposing sides thereof. The stage assemblies 116 are coupled to and extend between the hub plates 118. A respective disc plate 120 (only one of which is shown in FIG. 4) is spaced from each hub plate 118 by a cylindrical post 122 and is fixed to the housing 108 (shown in FIG. 3) of the wood-cutting machine 100 to couple the indexing station 104 to the housing 108. A motor 124 is coupled to a drive shaft 126 coupled to one hub plate 118. The motor 124 drives the drive shaft 126 to rotate the hub plate 118 and, therefore, the stage assemblies 116. Two hub frames 128, 130 include a plurality of spokes 132. More particularly, each hub frame 128, 130 includes eight spokes 132 configured to separate and stabilize adjacent stage assemblies 116.

With reference still to FIG. 4, each stage assembly 116 includes a top plate 140, a bottom plate 142, and two side plates 144. Each side plate 144 is coupled to one of the hub plates 118 on either side of the indexing station 104. The top plate 140 and the bottom plate 142 of each stage assembly 116 are coupled to the side plates 144. The top plate 140 and the bottom plate 142 may be additionally or alternatively coupled to one or both of the hub plates 118. The bottom plate 142 and the top plate 140 of adjacent stage assemblies 116 are coupled to a spoke 132 of each of the hub frames 128, 130.

Each stage assembly 116 further includes at least one clamp 146 for securing the wood plank or partially formed stave as it moves through the indexing station 104. In the illustrated embodiment, each stage assembly includes three clamps 146. Each clamp 146 include a base 148, coupled to the bottom plate 142 of the stage assembly 116, and a leg 150, coupled to the top plate 140 of the stage assembly 116. Each leg 150 terminates in a foot 152, each foot 152 directly opposing a respective base 148. Each clamp 146 includes or is coupled to an actuator 154, which actuates a respective leg 150 of each clamp 146 to travel towards the base 148 and clamp any object therebetween (i.e., a wood plank or partially formed stave). In the illustrated embodiment, each leg 150 includes an air cylinder 156 that serves as the actuator 154 thereof. A rotary union 158 is coupled to each air cylinder 156 and includes a plurality of stationary valves (not shown) configured to channel air to the air cylinders 156 to open and/or close the air cylinder 156. It should be understood that any suitable actuator may be used for some or all of clamps 146. For example, in some embodiments, electronic clamps may be used, and a rotatory union may be employed to pass electronic signals to actuate the electronic clamps.

Each of the stage assemblies 116 is configured to receive and retain (i.e., clamp) a wood plank or partially formed stave therein, between the top and bottom plates 140, 142 thereof. Once a wood plank or partially formed stave is clamped in a stage assembly 116, the stage assembly 116 is able to transfer that wood plank or partially formed stave between each stage of the indexing station 104.

Figure 5:
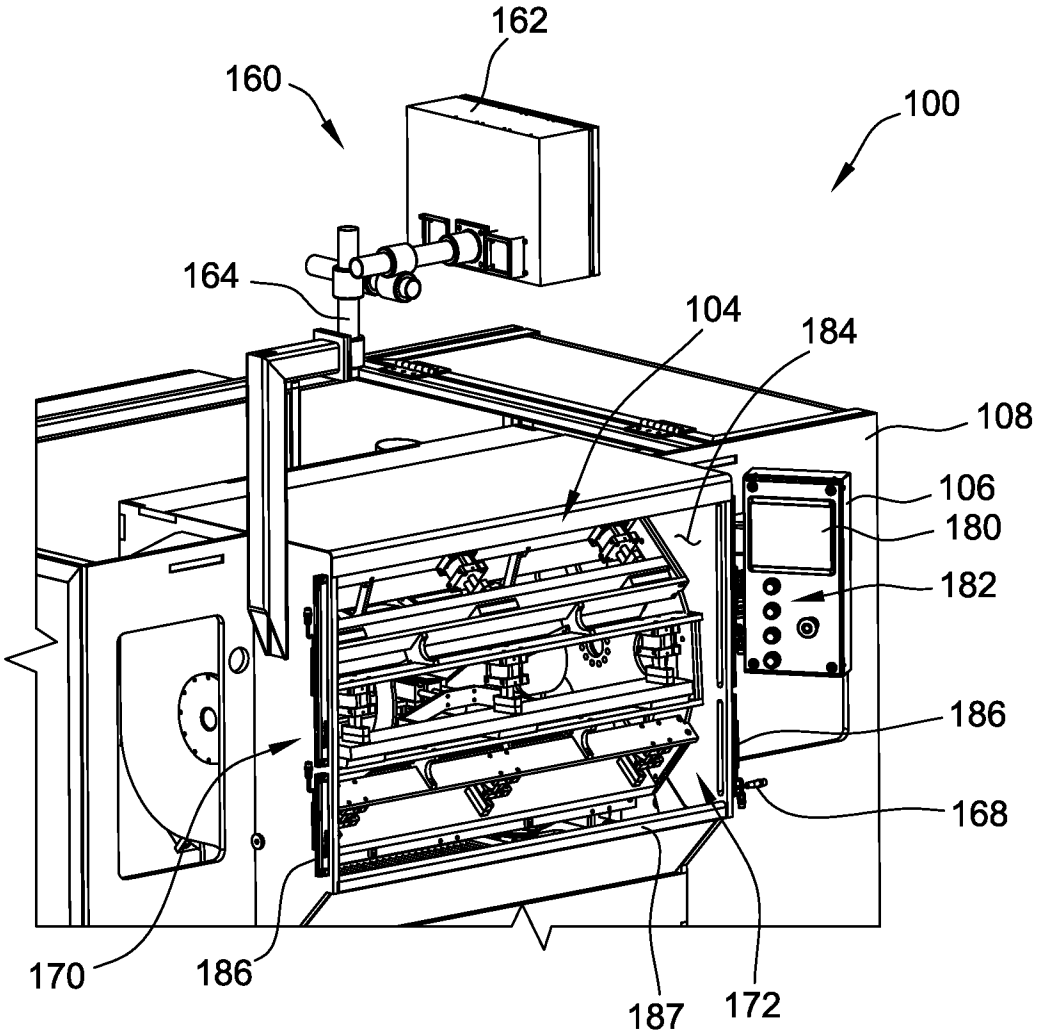
FIG. 5 is an enlarged, fragmentary front perspective of the wood-cutting machine of FIG. 3.

With reference now to FIGS. 3-5, the illustrated wood-cutting machine 100 further includes a projection assembly 160 (broadly, an "alignment assembly"). The projection assembly 160 in the illustrated embodiment includes a projector 162 and an arm 164 to couple the projector 162 to the housing 108. The projector 162 is configured to project a cut line (broadly, an "alignment aid") onto a wood plank or half-formed stave in a first stage 170 of the indexing station 104 to thereby facilitate the proper alignment of the wood plank or half-formed stave by the operator 102. In one example embodiment, the projected cut line indicates a shape or profile of a finishing cut to be performed on the wood plank or half-formed stave. For example, in one suitable embodiment, the projected cut line is curved and represents the curved profile of a finished stave. This first stage 170 may be alternatively referred to as a receiving stage and/or an alignment stage.

In one suitable embodiment, the projector 162 includes a laser or other form of concentrated light. In such an embodiment, the operator 102 manually maneuvers the wood plank or half-formed stave within the stage assembly 116 at the first stage 170, until the wood plank or half-formed stave is optimally aligned relative to the projected cut line. "Optimally," as used herein, refers generally to a subjective designation by the operator 102 according to their experience in forming staves (or otherwise cutting wood planks) as to the best placement of the cut line on the wood plank or half-formed stave. Once the operator 102 is satisfied with the position of the projected cut line on the wood plank or half-formed stave, the operator 102 manually activates the indexing station 104 to move the respective wood plank or half-formed stave to a second stage 172.

At the first stage 170, a plurality of distance sensors 178 (only one of which is shown) is used to measure the distance to both ends of the wood plank that the operator 102 is aligning. In one suitable embodiment, wood-cutting machine 100 includes three distance sensors 178 to measure a width of the wood plank at middle and at both ends of the wood plank. For a cut on a first edge of the wood plank, the finished width of the wood plank is estimated. For instance, a middle sensor of the three distance sensors 178 is used to measure the width of the wood plank. For a cut on a second, opposite edge of the wood plank (e.g., a half-formed stave), the measurement made by the two distance sensors 178 on the ends of the wood plank ("end sensors") is a "true" measurement of the first, cut edge. For instance, the end sensors 178 are used to measure an amount of taper already cut into the half-formed stave after the first edge of the stave is cut. Accordingly, any calculations of a finished width and determinations of a final cut to be made will be accurate (compensating for any error in the first cut edge).

In one suitable embodiments, when calculating a profile of the cut to be performed on the first edge of the wood plank, the operator 102 estimates an amount of material that will be removed during the cut. The operator 102 chooses the edge of the wood plank with the most material to be removed to cut first, to facilitate making the estimated final shape of the wood plank (e.g., a finished stave) as accurate as possible. By default, the wood-cutting machine 100 (e.g., the controller 106) estimates a small, fixed amount of material to be removed on the second edge, in order to estimate the finished width of the wood plank and accurately calculate the shape of the first edge profile. Any error in the width measurement and resulting shape in the first edge profile is measured by the distance sensors 178 when the operator 102 is aligning the second edge of the half-finished stave to the projected cut line, and this error is compensated for in the calculation of the second cut profile.

When the operator 102 is aligning the wood plank for the first cut, the operator 102 may notice that there will be more than a "typical" (e.g., default estimated) amount of material removed when the second edge of the wood plank is cut. For instance, the operator 102 may see a defect (e.g., a knot) that will be removed to finish the second edge of the wood plank. To make the calculation of the cut line for the first edge profile as accurate as possible, the operator 102 can indicate that more material will need to be removed on the second cut, for example, using the controller 106 to override a default value. Such input to the controller 106 is made using one or more input devices (e.g., a button, foot-actuated switches, etc.) The controller 106 then uses this input to change the estimated final width of the wood plank, to account for additional material being removed from the second edge of the wood plank. This adjustment improves the shape of the first edge profile and minimizes the amount that the second edge profile has to be altered to compensate for error.

In addition, an alignment actuator 179 is located at the first stage 170 and may be used to align the wood plank when a "parallel stave" is being formed. Parallel staves, which are traditionally used to make a barrel (such as barrel 70) have both ends of the same width. The alignment actuator 179 is configured to extend into the first stage 170 (i.e., radially outwards) to allow the operator 102 to square the first cut edge of the half-formed stave while aligning the cut position of the second (uncut) edge. When the indexing station 104 is activated, the alignment actuator 179 retracts to allow the indexing station 104 to advance. The alignment actuator 179 may be activated and/or deactivated, based on the particular needs of the operator 102 in aligning the wood plank in the first stage 170.

In the illustrated embodiment, the wood-cutting machine 100 includes a foot pedal 166 (broadly, an actuator) operatively connected to the indexing station 104 for activation of the indexing station 104. In one suitable embodiment, the pedal 166 is operatively coupled to the indexing station 104 via a wireless connection. When the pedal 166 is depressed, the pedal 166 transmits a signal to a transceiver 168 (e.g., an antenna) of the wood-cutting machine 100. The transceiver 168 (and/or additional internal components, not shown) is configured to process the received signal into a control signal to activate the indexing station 104. For example, the transceiver 168 processes the received activation signal from the pedal 166 into a control signal for the motor 124 (which may be transmitted wirelessly and/or via a wired connection to the motor 124). In other suitable embodiments, the pedal 166 can be operatively connected to the indexing station 104 via a wired connection and/or via a mechanical connection. It is understood that any suitable actuator can be used to activate the indexing station 104, such as a button, a lever, a toggle, etc. However, facilitating activation of the indexing station 104 using the foot pedal 166, as shown in the accompanying figures, enables the operator 102 to activate the indexing station 104 without the use of their hands, which may be more efficient than an alternative embodiment in which the operator 102 would need to move their hand(s) to activate the actuator.

Activating the indexing station 104 initiates a number of processes, including actuation of the clamps 146 of the stage assembly 116 in the first stage 170 and, subsequently, rotation of the indexing station 104 to transfer the stage assembly 116 at the first stage 170 to the second stage 172 (shown in FIG. 5). In fact, every stage assembly 116 is advanced one stage when the indexing station 104 is activated (i.e., the stage assembly 116 at the second stage 172 is advanced to a third stage, etc.). In the illustrated embodiment, a number of the stages are inactive stages. As used herein, an "inactive stage" is a stage wherein the wood plank or partially formed stave is not positively acted on. In other words, the wood plank or partially formed stave passes through the inactive stage in the same condition and alignment as it entered the stage. In addition, at least one stage is a "cutting stage" (e.g., the third or fifth stages, as described herein). As used herein, a "cutting stage" is a stage wherein the wood plank or partially formed stave is acted on, or, more specifically, cut by one or more cutting implemented (e.g., blades).

With reference now to FIGS. 3 and 5, the wood-cutting machine 100 also includes a controller 106 attached to the housing 108. The controller 106 includes a screen 180 (or display) as well a plurality of input devices 182 (illustrated as buttons and/or knobs). The controller 106 enables the operator 102 to view, update, edit, start, stop, and/or otherwise manipulate processes performed by the wood-cutting machine 100. For example, the operator 102 may use the controller 106 to activate the rough-cutting assembly and de-activate the finishing assembly (shown and discussed further herein). It is understood that the controller 106 can be any suitable controller and that the controller 106 can be located remote from the wood-cutting machine 100. It is also understood that the screen 180 can be a touch screen so that the screen is both the display and the input devices.

In the illustrated embodiment, the housing 108 of the wood-cutting machine 100 includes an open window 184 to the indexing station 104 (see FIGS. 3 and 5). The open window 184 permits access by the operator 102 to the stage assembly 116 at the first stage 170, such that the operator 102 can insert, manipulate, align, and remove the wood plank or half-formed stave to/from the first stage 170. A plurality of sensors 186, such as light and/or motion sensors, are arranged around a perimeter of the open window 184. The sensors 186 are directed towards the plane of the open window 184 and are configured to sense whether anything (e.g., a hand of the operator 102) has broken that plane. In the example embodiment, the sensors 186 output an override signal that prevents activation of the indexing station 104 when the plane of the open window 184 is broken. Accordingly, the sensors 186 improve the safety of operating the wood-cutting machine 100, inhibiting the operator 102 from getting their extremities, clothing, and/or other items caught within the indexing station 104. The wood-cutting machine 100 further includes a guard 187. The guard 187 is configured to inhibit the operator 102 from breaking the plane of the open window 184 when the indexing station 104 is moving by pivoting upwards and covering at least a portion of the open window 184.

In one suitable embodiment, the housing 108 further includes one or more indicators (not shown), such as a light or audible signal device. The one or more indicators are used to indicate to the operator 102 that the wood plank in the stage assembly 116 that will be advanced into the first stage 170 is finished (i.e., has been cut on both edges). When the one or more indicators is activated (e.g., the light is on), the operator 102 knows, without examining the wood plank that is advanced into the first stage 170 when the indexing station 104 is activated, that the wood plank is a finished piece. Accordingly, throughput may be increased. Additionally or alternatively, one indicator may indicate that the wood plank in the next stage assembly 116 is finished, and another indicator may indicate that the wood plank in the next stage assembly 116 is half-finished.

Figure 6:
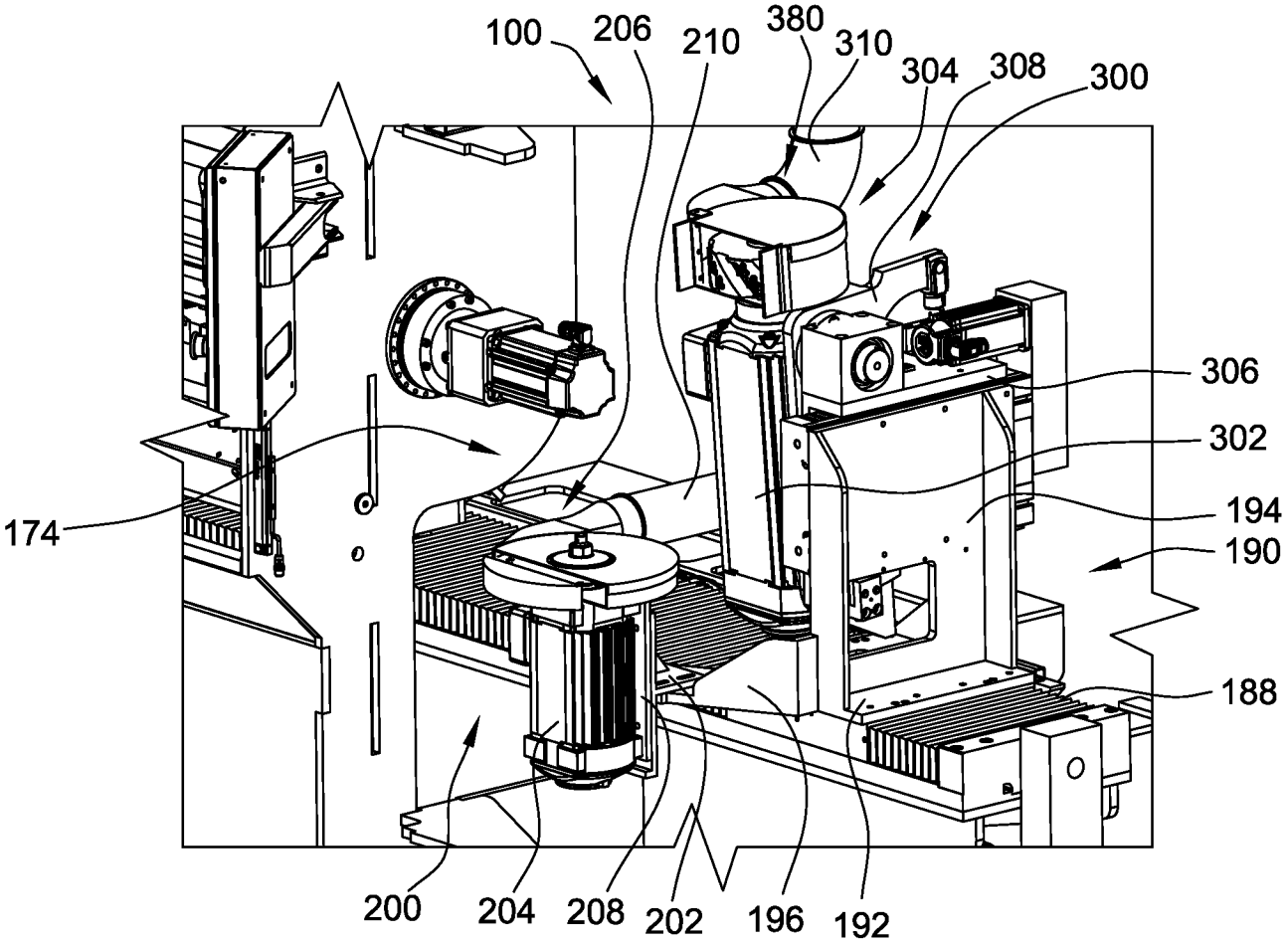
FIG. 6 is an enlarged, fragmentary side perspective of the wood-cutting machine of FIG. 3.

FIG. 6 is an enlarged, fragmentary perspective of the wood-cutting machine 100 seen in FIG. 3, with a portion of the housing 108 removed such that internal components of the wood-cutting machine are visible. In this view, the rough-cutting assembly 200 and the finishing assembly 300 are illustrated. Generally, the rough-cutting assembly 200 performs a rough cut on the wood plank or half-formed stave in a third stage 174 of the indexing station 104. The finishing assembly 300 performs a finishing cut that corresponds to the cut line initially projected on the wood plank or half-formed stave at the first stage 170. The finishing assembly 300 also bevels or otherwise contours the edge of the wood plank or half-formed stave. The finishing assembly 300 cuts the wood plank or half-formed stave at a fifth stage 176 of the indexing station 104 (shown in FIG. 11).

In the illustrated embodiment, the rough-cutting assembly 200 and the finishing assembly 300 of the wood-cutting machine 100 travel along a linear path defined by a track 188. More specifically, the rough-cutting assembly 200 and the finishing assembly 300 are coupled to a transport mechanism 190 that moves along the track 188. Accordingly, the rough-cutting assembly 200 performs the rough cut on the wood plank or half-formed stave in the third stage 174 simultaneously with the finishing assembly 300 performing the finishing cut/bevel on a different wood plank or half-formed stave at the fifth stage 176. In another suitable embodiment, the rough-cutting assembly 200 and the finishing assembly 300 are not coupled to the same transport mechanism 190, such that each assembly 200, 300 may perform its respective cut other than simultaneously with the other assembly 200, 300. In other words, the rough-cutting assembly 200 and the finishing assembly 300 can be operated independently of the other.

The transport mechanism 190 includes a base 192 moveably coupled to the track 188 and a support plate 194 coupled to and extending from the base 192. Two side panels 196 extend from the base 192 to the support plate 194. In the illustrated embodiment, the transport mechanism 190 is screw-driven. A motor 198 (see FIG. 3) turns a screw (not shown) to drive the transport mechanism 190 along the track 188. In other embodiments, the transport mechanism 190 may be driven using an alternative drive mechanism, such as a belt drive.

Figure 7:
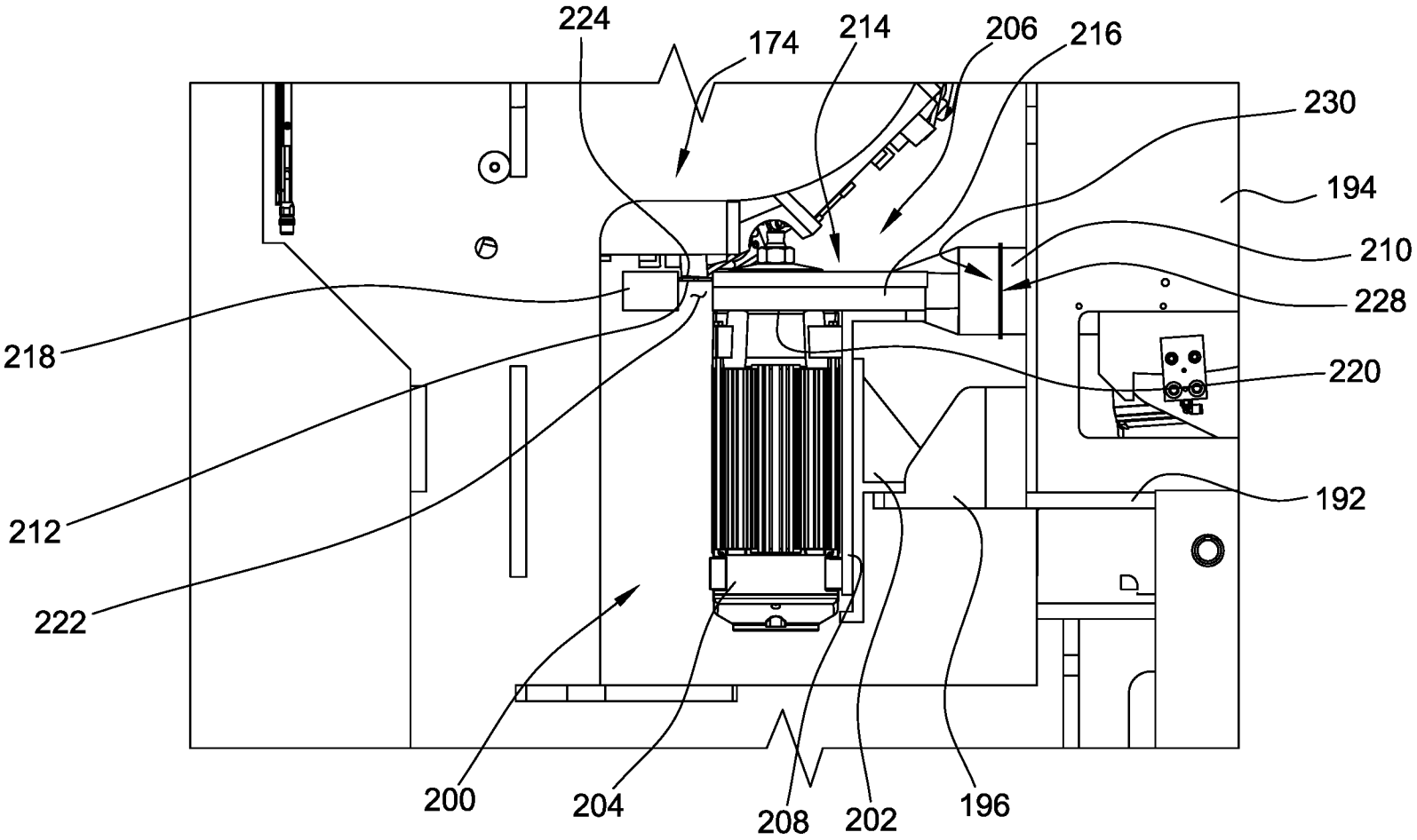
FIG. 7 is an enlarged, fragmentary side view of a rough-cutting assembly of the wood-cutting machine of FIG. 3.

A bracket 202 fixedly couples the rough-cutting assembly 200 to the base 192 of the transport mechanism 190. The rough-cutting assembly 200, as shown in FIGS. 6 and 7, includes a motor 204, a head 206, a mounting plate 208, and a dust collection duct 210. The head 206 includes a circular saw blade 212 as well as a guard 214. Although the blade 212 is illustrated as a circular saw blade 212, other suitable embodiments may include alternative saw blades 212, such as a band saw or reciprocating saw. The rough-cutting assembly 200 could additionally or alternatively include a chip/saw blade to eliminate the strip of wood that is generated as waste material during the rough-cut in the third stage 174 (described further herein). In such an embodiment, the chip/saw blade would include both a saw, to cut the rough profile, and chipping blades behind the saw, to chip up the waste material. The saw blade 212 is mounted to the motor 204 and/or to a drive shaft thereof at a center of the blade 212. The motor 204 drives the saw blade 212 to rotate. The motor 204 operates in response to a control signal, for example, transmitted by the controller 106 and/or the transceiver 168. The control signal may be transmitted after the indexing station 104 has been activated, for example, once the indexing station 104 has come to a stop. Additionally or alternatively, the control signal may be transmitted in response to a separate activation signal received from the operator 102 (e.g., from an input device 182 of controller 106).

The guard 214 includes a first portion 216 and a second portion 218. The first portion 216 surrounds a rearward portion of the blade 212, in the illustrated embodiment, and is coupled to the mounting plate 208 to fix the guard 214 in place. Although the first portion 216 of the guard 214 is illustrated in a two-piece embodiment, it should be understood that the first portion 216 of the guard 214 may be a single, integrally formed piece (e.g., molded as a single piece). The second portion 218 of the guard 214 surrounds a forward portion of the blade 212. The second portion 218 of the guard 214 may be removably coupled to the first portion 216 of the guard 214 at a bottom surface 220 thereof.

The first portion 216 and the second portion 218 of the guard 214 define a linear window 222 through which the saw blade 212 is exposed. As best seen in FIG. 7, this linear window 222 substantially aligns with the wood plank or half-formed stave 223 in the third stage 174. As the transport mechanism 190 moves along the track 188, the rough-cutting assembly 200 is moved substantially parallel to an uncut edge 224 of the wood plank or half-formed stave 223. The saw blade 212, exposed by the linear window 222 to the wood plank or half-formed stave 223, passes through the wood plank or half-formed stave 223 to perform a rough cut on the wood plank or half-formed stave 223 along a predetermined cut pathway. It should be understood that alternative guards 214 may be used with the rough-cutting assembly 200, such as a guard without a second portion, such that a forward portion of the saw blade 212 is fully exposed to the wood being cut in the third stage. Moreover, alternative guards 214 may be configured, size, and/or shaped differently to accommodate different sizes and/or configuration of wood to be cut thereby (e.g., having a larger linear window 222 to accommodate thicker wood).

Figure 8A:
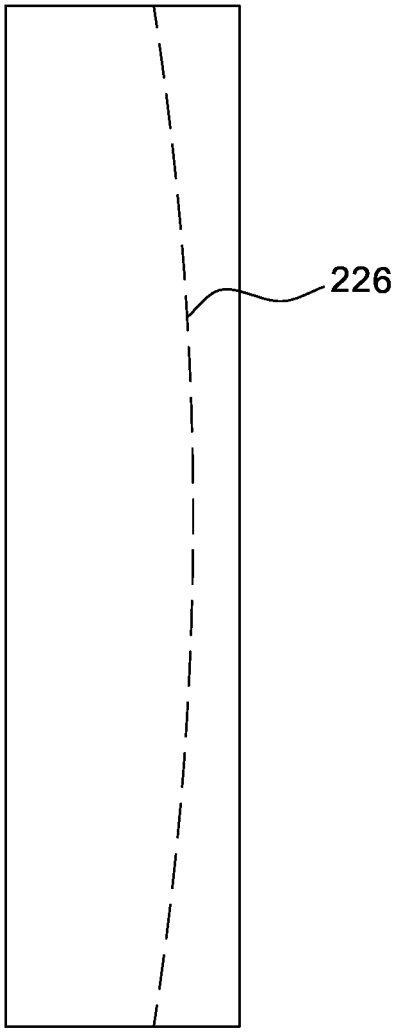
FIG. 8A is a top view of a wood plank suitable for use with the wood-cutting machine of FIG. 3 illustrating a projected cut line, which is projected from a projection assembly of the wood-cutting machine.
Figure 8B:
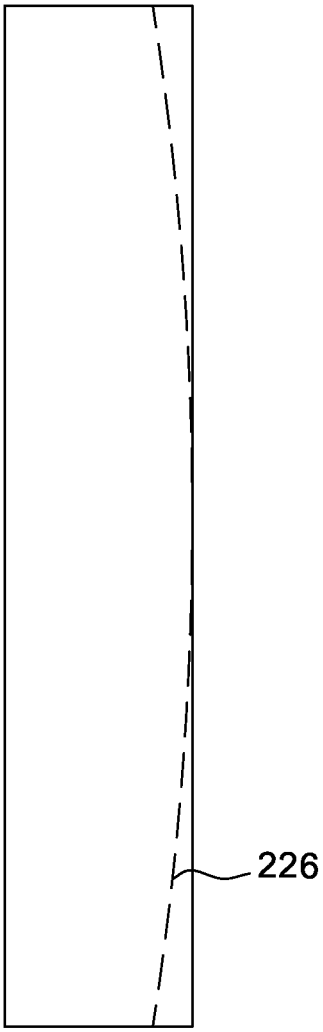
FIG. 8B is a top view of a stave, the stave having been formed by the rough-cutting assembly of the wood-cutting machine cutting the wood plank of FIG. 8A along the projected cut line.

FIGS. 8A and 8B show, respectively, examples of a wood plank with a projected cut line 226 thereon (e.g., in the first stage 170 of the indexing station 104) and the same wood plank after the rough cut is performed (e.g., at the third stage 174). In the example embodiment, the rough cut is performed along a predetermined cut pathway defined by a tangent of the cut line 226 corresponding to a widest dimension of the wood plank. Put another way, the rough cut of the rough-cutting assembly 200 cuts off the maximum amount of wood available before the maximum width of the wood plank would be reduced by the cut.

Returning to FIGS. 6 and 7, the dust collection duct 210 is in flow communication with the head 206 of the rough-cutting assembly 200. More particularly, a mouth 228 of the dust collection duct 210 is in flow communication with an outlet 230 of the guard 214. The dust collection duct 210 is coupled to a vacuum system (not shown) at an end of the dust collection duct 210 opposite the mouth 228. As the blade 212 cuts through the wood plank or half-formed stave, sawdust, wood chips, and wood shavings are generated. The larger debris, such as wood chips and larger wood shavings, fall through the guard 214 into the debris collection portion 112 of the wood-cutting machine 100. The smaller debris is drawn into the dust collection duct 210 by the vacuum system and is collected at a collection station (not shown) for subsequent handling. Accordingly, little to no debris "escapes" the wood-cutting machine 100 to dirty the operating environment 110.

Figure 9:
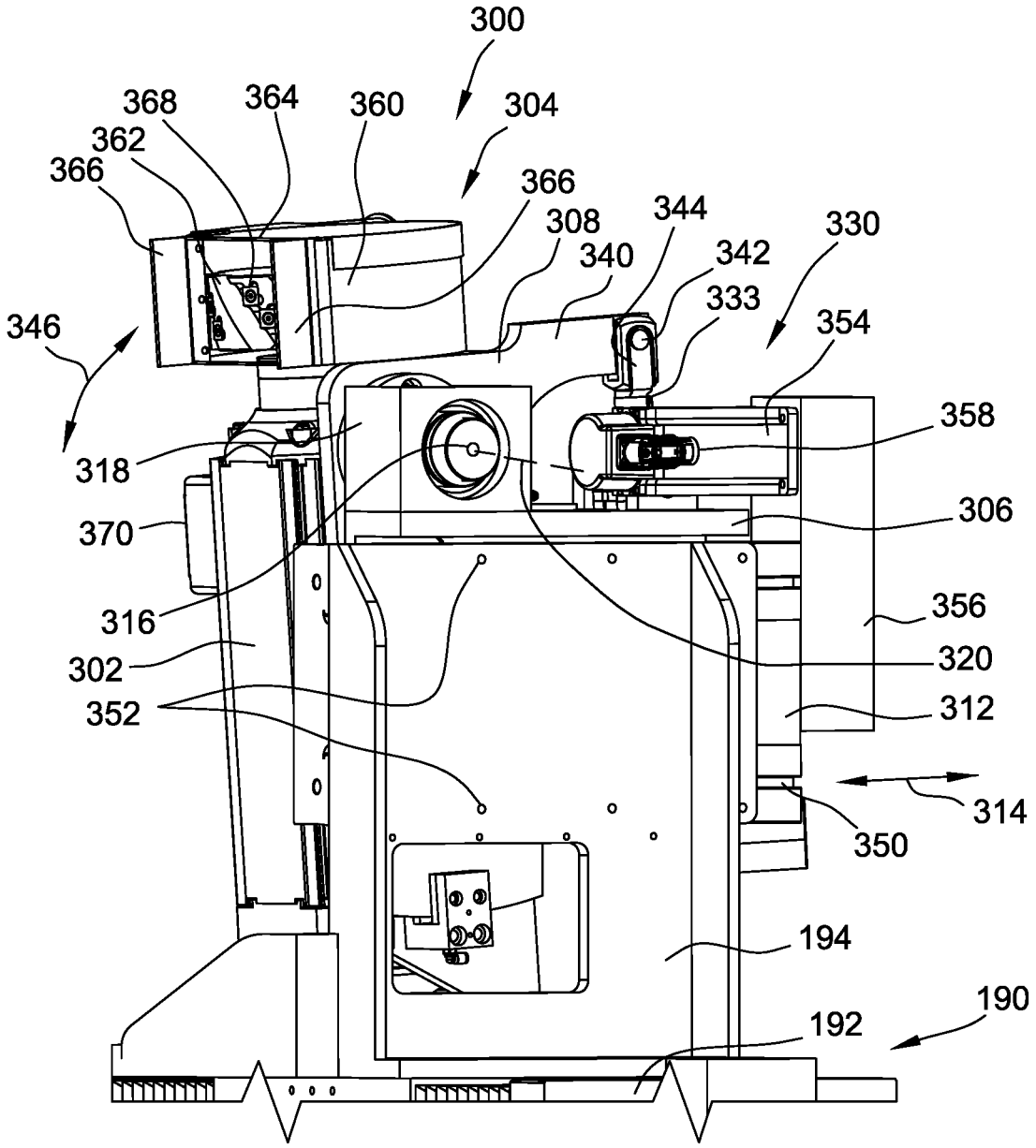
FIG. 9 is an enlarged, fragmentary side perspective view of a finishing assembly of the wood-cutting machine of FIG. 3.
Figure 10:
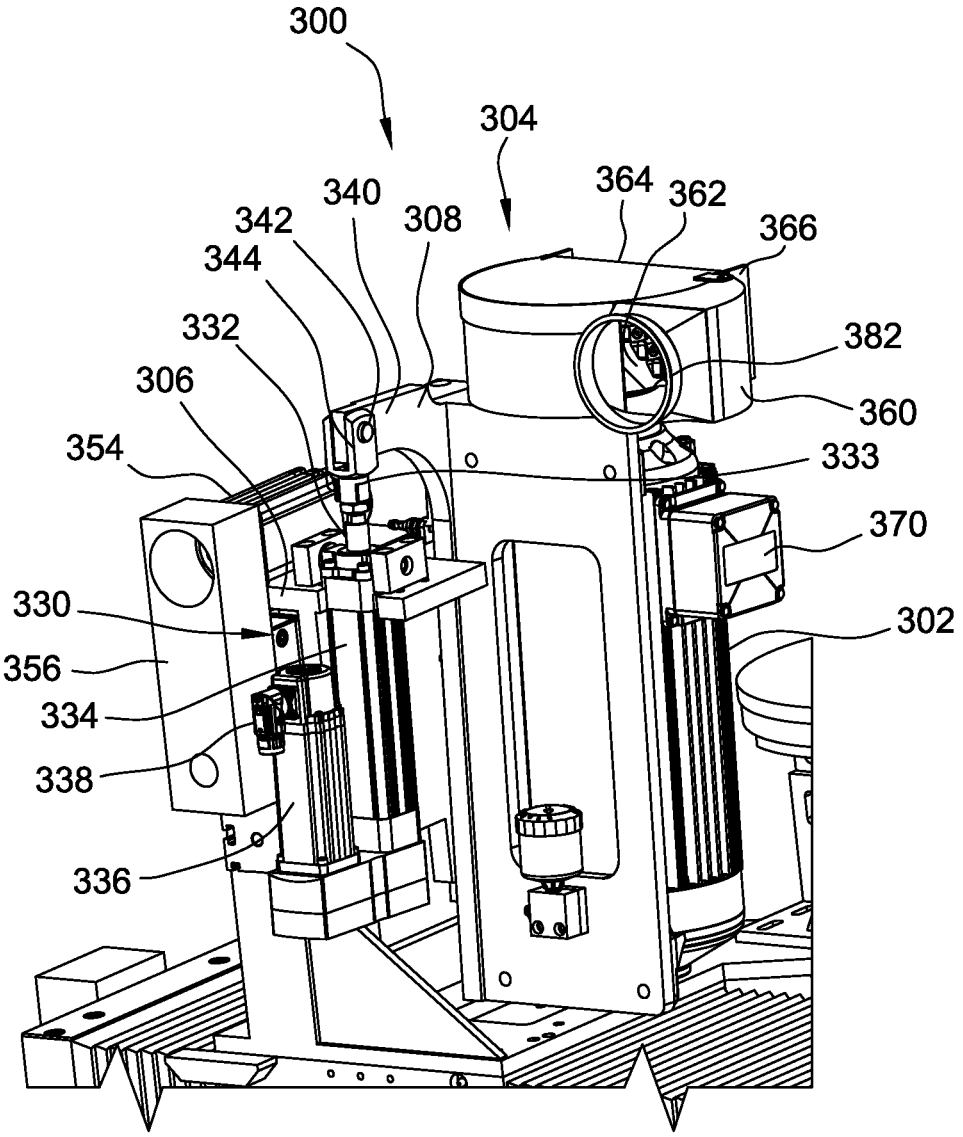
FIG. 10 is an enlarged, fragmentary rear perspective view of the finishing assembly seen in FIG. 9.
Figure 11:
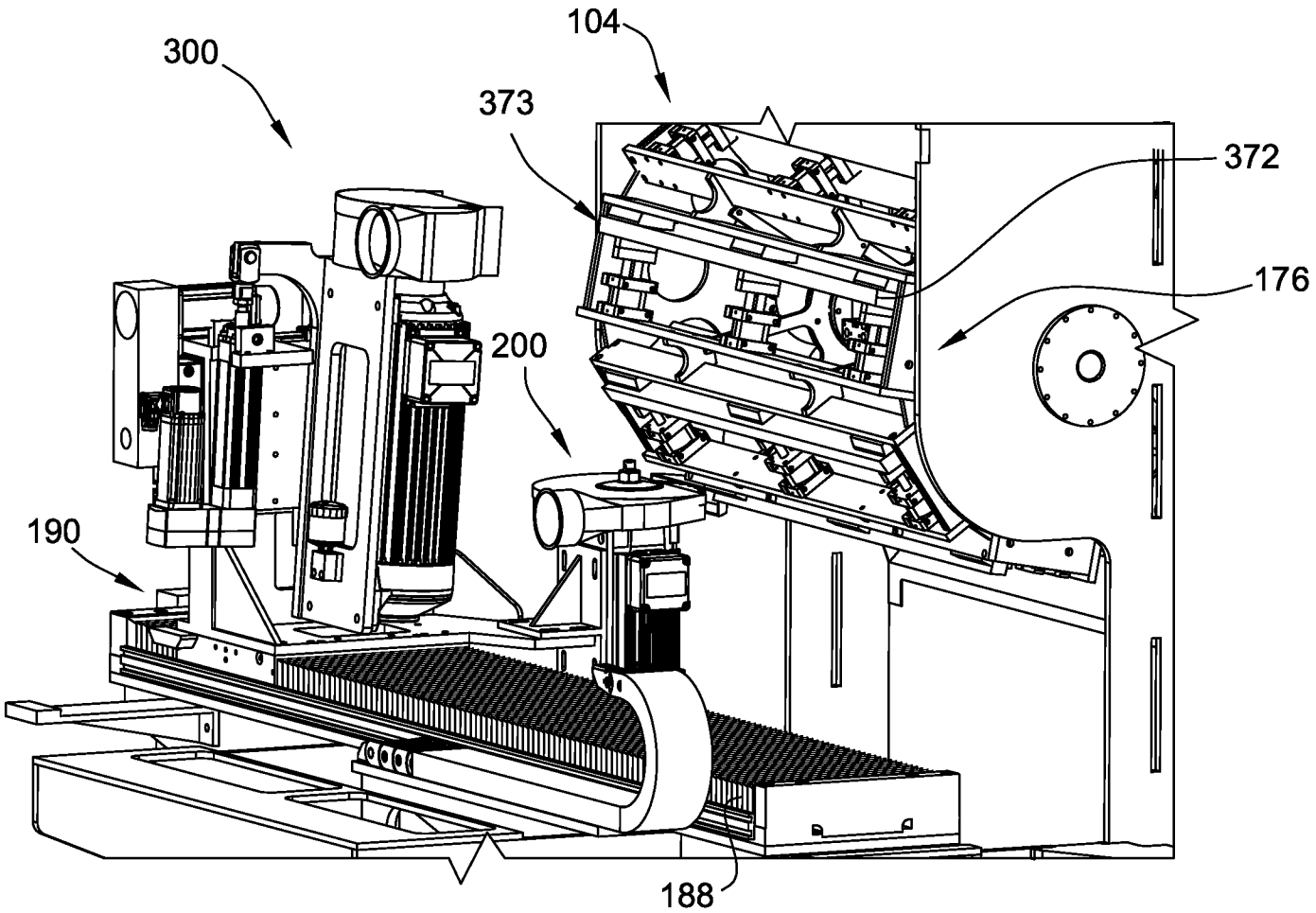
FIG. 11 is an enlarged, fragmentary rear perspective of the wood-cutting machine of FIG. 3.

With reference to FIGS. 6 and 9-11, the finishing assembly 300 is illustrated in further detail. As shown in FIG. 6, the finishing assembly 300 generally includes a motor 302, a head 304, two connection plates 306, 308, and a dust collection duct 310. FIGS. 9 and 10 illustrate a side perspective view and a rear perspective view, respectively, of the finishing assembly 300 with the dust collection duct 310 removed therefrom, and FIG. 11 shows a rear perspective view of the wood-cutting machine 100 more generally. A mounting plate 312 couples the finishing assembly 300 to the support plate 194 of the transport mechanism 190. The mounting plate 312, as discussed further herein, is configured to be translated forwardly and rearwardly (e.g., along an axis 314 shown in FIG. 9) with respect to the support plate 194. The finishing assembly 300 is also configured to translate as well as to pivot with respect to the mounting plate 312 and the transport mechanism 190. In particular, the finishing assembly 300 is configured to translate and pivot such that the finishing assembly 300 can cut a wood piece (e.g., the wood plank or half-formed stave) in the fifth stage 176 with a nonlinear (e.g., curved) cut and/or can bevel the wood piece.

The finishing assembly 300 pivots via a pivot shaft 316 housed in a fixed casing 318. The fixed casing 318 is fixedly coupled to a translation connection plate 306, described further herein. The pivot shaft 316 rotates within the fixed casing 318 and defines an axis of rotation 320 about which the finishing assembly 300 pivots. A piston sub-assembly 330 is also mounted to the translation connection plate 306. The piston sub-assembly 330 is configured to control the pivoting motion of the finishing assembly 300. The piston sub-assembly 330 includes a piston 332 and an actuator 334. In the illustrated embodiment, the actuator 334 includes an internal ball screw (not shown) driven by a pivot motor 336. The pivot motor 336 includes a receiver 338 configured to receive control signals (e.g., from the controller 106 and/or the transceiver 168) to control the actuator 334 to drive (e.g., raise or lower) the piston 332, which causes the finishing assembly 300 to pivot. The finishing assembly 300 includes a pivot connection plate 308. The motor 302 and head 304 of the finishing assembly 300 are fixedly coupled to the pivot connection plate 308. The pivot connection plate 308 includes an arm 340 that is pivotally coupled to an end 333 of the piston 332 (e.g., using a pin 342 and bracket 344 connection). In addition, the pivot shaft 316 of the finishing assembly 300 is mounted at one end thereof to the pivot connection plate 308 (see FIG. 9).

Accordingly, when the piston 332 is raised up and out of the cylinder 334, the end 333 of the piston 332 rises. This, in turn, raises the arm 340 of the pivot connection plate 308. The pivot connection plate 308, and the components of the finishing assembly 300 mounted thereto, pivot (via the pivot shaft 316) about the axis of rotation 320. In this manner, the head 304 of the finishing assembly 300 is moved substantially arcuately along a substantially arcuate path 346 (see FIG. 9). It should be understood that this arcuate path 346 is translated forwardly and rearwardly as the finishing assembly 300 is translated, as discussed further herein.

The mounting plate 312 has tracks 350 defined therein. These tracks 350 are configured to receive corresponding rails (not shown) defined on the surface of the support plate 194 of the transport mechanism 190. The mounting plate 312 can be translated along the support plate 194 using this rail-track connection. In an alternative embodiment, the mounting plate 312 includes rails and the support plate 194 includes tracks to receive the rails of the mounting plate 312. In still other embodiments, the mounting plate 312 and/or the support plate 194 include(s) any other cooperating elements that facilitate the translation of the mounting plate 312 as well as the coupling of the mounting plate 312 to the support plate 194. In the illustrated embodiment, the mounting plate 312 is manually adjusted (i.e., translated) with respect to the support plate 194 for a "rough" translation of the finishing assembly 300. The mounting plate 312 is then fixedly secured to the support plate 194 via fasteners (not shown) seated within holes 352 in the support plate 194 to prevent movement of the mounting plate 312 with respect to the support plate 194 during use of the finishing assembly 300.

In the illustrated embodiment, the finishing assembly 300 further includes a translation motor 354 fixedly coupled to the mounting plate 312 via an arm 356. The translation motor 354 includes a receiver 358 configured to receive control signals for the translation motor 354. According to the received control signals, the translation motor 354 controls translation of the translation connection plate 306 with respect to the mounting plate 312. The translation motor 354 is operatively coupled to the mounting plate 312 via one or more mechanical connections (not shown) through the arm 356. For example, the translation motor 354 may drive a linear actuator (e.g., a screw mechanism) within the arm 356 and/or the mounting plate 312 that causes the translation connection plate 306 to translate with respect to the mounting plate 312 (e.g., similar to the mechanism that drives the transport mechanism 190 along the track 188). Translation of the translation connection plate 306 effects a "finer" translation of the finishing assembly 300. Moreover, this translation can occur during use of the finishing assembly 300 (e.g., as the finishing assembly 300 is cutting the wood plank or half-formed stave in the fifth stage 176). The translation of the translation connection plate 306 is combined or blended with the pivoting motion of the pivot connection plate 308 to create a curved profile (as previously determined using the projected cut line in the first stage 170) along the edge of the wood plank or half-formed stave in the fifth stage 176. As best seen in FIG. 9, the head 304 of the finishing assembly 300 includes a guard 360 partially surrounding a bladed drum 362, which may also be referred to as a spiral cutterhead or a helix cutterhead. The guard 360 is embodied as a singular piece coupled to the motor 302, but may be a two-piece guard in alternative embodiments. The guard 360 defines a front window 364 through which a forward portion of the blade drum 362 is exposed. A pair of guide strips 366 bound opposing sides of the front window 364. The guide strips 366 prevent small debris and dust from being expelled through the side of the front window 364. Thereby, the guide strips 366 facilitate improved dust collection by the dust collection duct 310, as described further herein, by keeping small debris and dust within the guard 360.

The blade drum 362 includes a plurality of blades 368 mounted in a helical arrangement to the blade drum 362. In the example embodiment, the blades 368 are square blades with four cutting edges and are fabricated from a durable metal such as carbide. The blade drum 362 is mounted to the motor 302 and/or to a drive shaft (not shown) thereof at a center of the blade drum 362. The motor 302 drives the blade drum 362 to rotate. The motor 302 operates in response to a control signal, for example, transmitted by the controller 106 and/or the transceiver 168 to a receiver 370 of the motor 302. The control signal may be transmitted after the indexing station 104 has been activated, for example, once the indexing station 104 has come to a stop. Additionally or alternatively, the control signal may be transmitted in response to a separate activation signal received from the operator 102 (e.g., from an input device 182 of the controller 106).

With reference to FIG. 11, as the transport mechanism 190 advances along the track 188, the forward portion of the blade drum 362 contacts an exposed edge 372 of the wood plank or half-formed stave 373 at the fifth stage 176 of the indexing station 104. The blade drum 362 cuts the wood plank or half-formed stave along a predetermined cut pathway as it moves along the edge 372 of the wood plank or half-formed stave 373. The finishing assembly 300 may be translated rearward/forward and/or pivoted forward/rearward to accomplish the desired cut (as indicated by the cut line initially projected on the wood plank or half-formed stave at the first stage 170). The exact position and orientation of the finishing assembly 300 throughout its travel along the track 188 is determined by the controller 106 when the parameters of the cut are defined (e.g., by the operator 102 using the input devices 182 of the controller 106 For example, the controller 106 may determine the appropriate angle (i.e., pivot position) and forward/rearward position of the finishing assembly 300 for a particular cut (e.g., beveled along a curved cut line) at each of a plurality of positions along the track 188. The controller 106 may transmit appropriate control signals to the pivot motor 336 and the translation motor 354 to operate as necessary to achieve such an angle and position.

Returning to FIG. 6, the dust collection duct 310 is in flow communication with the head 304 of the finishing assembly 300. More particularly, a mouth 380 of the dust collection duct 310 is in flow communication with an outlet 382 (see FIG. 10) of the guard 360. The dust collection duct 310 is coupled to the vacuum system (not shown) at an end of the dust collection duct 310 opposite the mouth 380. As the blade drum 362 cuts through the stave 373, sawdust, wood chips, and wood shavings are generated. The larger debris, such as wood chips and larger wood shavings, fall into the debris collection portion 112 of the wood-cutting machine 100. The guide strips 366 and the vacuum system draw smaller debris into the dust collection duct 310, and this smaller debris is collected at the collection point (not shown) for subsequent removal and cleaning.

In one example embodiment, a method of using the semi-automated wood-cutting machine 100 to cut a wood plank is described. In some embodiments, the wood plank is cut into a stave (such as the stave 60 shown in FIG. 1B) for forming a barrel (such as the barrel 70 shown in FIG. 2). An operator 102 first inserts a wood plank (such as the wood plank 50 shown in FIG. 1A) or half-formed stave into a stage assembly 116 at the first stage 170 of the indexing station 104 of the wood-cutting machine 100. The projector 162 projects a cut line onto the wood plank. The operator 102 maneuvers the wood plank within the first stage 170 until the projected cut line is optimally aligned on the wood plank. The operator 102 than actuates an actuator (e.g., foot pedal 166) to activate the indexing station 104. The wood-cutting machine 100 receives an activation signal (e.g., via a transceiver 168) and actuates (e.g., via a controller 106) clamps 146 to clamp the wood plank in the stage assembly 116. The wood cutting machine 100 also advances the indexing station 104 such that the stage assembly 116 advances from the first stage 170 to the second stage 172. The operator 102 continues to load a plurality of stage assemblies 116 in this manner.

The wood-cutting machine 100 activates the rough-cutting assembly 200 to perform a rough cut along a longitudinally extending edge of the wood plank in a subsequent cutting stage (e.g., a third stage 174). In one embodiment, the wood-cutting machine 100 automatically activates the rough-cutting assembly 200 in response to the activation signal, after the indexing station 104 is activated. The wood-cutting machine 100 also activates the finishing assembly 300 to perform a finishing cut (which may include a bevel or other contour) on a different wood plank in a subsequent cutting stage (e.g., a fifth stage 176). In the illustrated embodiment, the rough-cutting assembly 200 and the finishing assembly 300 are activated simultaneously. More particularly, the wood-cutting machine 100 activates the rough-cutting assembly 200 and finishing assembly 300 and transports the assemblies 200, 300 along a track 188 to cut the wood planks. In an alternative embodiment, the rough-cutting assembly 200 and the finishing assembly 300 operate independently, such that the wood-cutting machine 100 activates the rough-cutting assembly 200 and the finishing assembly 300 at different times.

The wood-cutting machine described herein provides a number of advantages over known wood-cutting machines, such as increased throughput and higher-quality finished wood pieces (e.g., staves). In addition, the wood-cutting machine provides a cleaner operating environment, by including the debris collection portion of the housing that prevents or eliminates debris in the operating environment. The wood-cutting machine further improves safety for the operators thereof, by removing the cutting assemblies from the operators within the housing and by providing the sensors around the front window to prevent injury to operator.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting sense.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A semi-automated wood-cutting machine comprises:

an indexing station comprising a plurality of stage assemblies arranged in a circular fashion about a central axis and configured to travel along a predetermined circular route between a plurality of stages, wherein the plurality of stages comprises:

a receiving/alignment stage at which a first stage assembly of the plurality of stage assemblies is adapted to receive a piece of wood, the receiving/alignment stage including a plurality of distance sensors configured to measure a width of the piece of wood at a plurality of locations along the piece of wood, and an alignment aid adapted to facilitate manual alignment of the piece of wood by an operator of the semi-automated wood-cutting machine, wherein the alignment aid comprises a projector configured to generate a projected cut line that is dynamically generated by the semi-automated wood-cutting machine based upon the measured width of the plurality of locations along the piece of wood; and a cutting stage spaced along the circular route from the receiving/alignment stage, wherein, at the cutting stage, the piece of wood is cut along a predetermined cut pathway defined by the projected cut line; and a safety window bounded by a housing enclosing the cutting stage comprising a plurality of safety sensors, the plurality of safety sensors configured to detect whether a plane of the safety window has been broken by an object and output an override signal that prevents activation of the indexing station.

2. The semi-automated wood-cutting machine of claim 1 wherein each stage assembly of the plurality of stage assemblies comprises a clamping device adapted to secure the piece of wood at the receiving/alignment stage.

3. The semi-automated wood-cutting machine of claim 1, wherein the receiving/alignment stage further comprises an alignment actuator configured to extend radially outward to facilitate squaring a cut longitudinal edge of the piece of wood while an uncut longitudinal edge is aligned using the alignment aid.

4. The semi-automated wood-cutting machine of claim 1, wherein the indexing station is configured to move the piece of wood from the receiving/alignment stage to the cutting stage.

5. The semi-automated wood-cutting machine of claim 4 further comprising an actuator to actuate movement of the indexing station.

6. The semi-automated wood-cutting machine of claim 5, wherein the actuator comprises a foot pedal operatively coupled to a motor configured to drive movement of the indexing station.

7. A semi-automated wood-cutting machine comprises:

an indexing station comprising a plurality of stage assemblies arranged in a circular fashion about a central axis and configured to travel along a predetermined circular route between a plurality of stages, wherein the plurality of stages comprises:

a receiving/alignment stage at which a first stage assembly of the plurality of stage assemblies is adapted to receive a piece of wood, the receiving/alignment stage including a plurality of distance sensors configured to measure a width of the piece of wood at a plurality of locations along the piece of wood, and an alignment aid adapted to facilitate manual alignment of the piece of wood by an operator of the semi-automated wood-cutting machine, wherein the alignment aid comprises a projector configured to generate a projected cut line that is dynamically generated by the semi-automated wood-cutting machine based upon the measured width of the plurality of locations along the piece of wood;

a rough-cutting stage spaced along the circular route from the receiving/alignment stage, wherein, at the rough-cutting stage, the piece of wood is cut along a predetermined cut pathway defined in part by the projected cut line; and a finishing stage spaced along the circular route from the receiving/alignment stage and the rough-cutting stage, wherein, at the finishing stage, at least one longitudinal extending edge of the piece of wood is contoured based on the projected cut line, and a safety window bounded by a housing enclosing the rough-cutting stage comprising a plurality of safety sensors, the plurality of safety sensors configured to detect whether a plane of the safety window has been broken by an object and output an override signal that prevents activation of the indexing station.

8. The semi-automated wood-cutting machine of claim 7 wherein each stage assembly of the plurality of stage assemblies comprises a clamping device adapted to secure the piece of wood at the receiving/alignment stage.

9. The semi-automated wood-cutting machine of claim 7 wherein the rough-cutting stage and the finishing stage act upon a single longitudinal extending edge of the piece of wood.

10. The semi-automated wood-cutting machine of claim 7, wherein the receiving/alignment stage further comprises an alignment actuator configured to extend radially outward to facilitate squaring a cut longitudinal edge of the piece of wood while an uncut longitudinal edge is aligned using the alignment aid.

11. The semi-automated wood-cutting machine of claim 7, wherein the indexing station is configured to move the piece of wood from the receiving/alignment stage to the rough-cutting stage and then to the finishing stage.

12. The semi-automated wood-cutting machine of claim 11 further comprising an actuator to actuate movement of the indexing station about the predetermined circular route.

13. The semi-automated wood-cutting machine of claim 12, wherein the actuator comprises a foot pedal operatively coupled to a motor configured to drive movement of the indexing station.

14. A method of cutting a piece of wood, the method comprises:

manually aligning a piece of wood relative to an alignment aid at a receiving/alignment stage of a semi-automated wood-cutting machine, the semi-automated wood-cutting machine including an indexing station having a plurality of stage assemblies arranged in a circular fashion about a central axis and configured to travel along a predetermined circular route between a plurality of stages, the plurality of stages including the receiving/alignment stage, wherein the receiving/alignment stage includes a plurality of distance sensors configured to measure a width of the piece of wood at a plurality of locations along the piece of wood during said manually aligning, wherein the alignment aid includes a projector configured to generate a projected cut line that is dynamically generated by the semi-automated wood-cutting machine based upon the measured width of the plurality of locations along the piece of wood;

actuating an actuator to move the piece of wood along the predetermined circular route from the receiving/alignment stage to a cutting stage of the plurality of stages; and cutting the piece of wood along at least one of its longitudinally extending edges at the cutting stage, and activating a plurality of safety sensors in a safety window that is bounded by a housing enclosing the cutting stage, the plurality of safety sensors operable to detect whether a plane of the safety window has been broken by an object and output an override signal that prevents activation of the indexing station.

15. The method of claim 14 further comprising:

receiving the piece of wood at the receiving/alignment stage;

turning the piece of wood; and inserting the piece of wood back into the receiving/alignment stage.

16. The method of claim 14 further comprising operating a foot pedal to instruct the actuator of the indexing station to actuate movement of the piece of wood along the predetermined circular route.

17. The method of claim 14 wherein cutting the piece of wood at the cutting stage comprises cutting the piece of wood along a cut pathway based on the projected cut line.

18. The method of claim 17 further comprising tapering the longitudinally extending edge of the piece of wood.

19. The method of claim 18 further comprising beveling the longitudinally extending edge of the piece of wood.

* * * * *